United States Patent [19]

Brandt et al.

[11] 4,142,238

[45] Feb. 27, 1979

[54] MONITORING SYSTEM

[75] Inventors: Robert W. Brandt, 65 Canal St., Apartment 20, San Rafael, Calif. 94901; Robert D. Fisher, Melrose Park; James E. Hill, Prospect Heights, both of Ill.

[73] Assignee: Robert W. Brandt, San Rafael, Calif.

[21] Appl. No.: 386,958

[22] Filed: Aug. 9, 1973

Related U.S. Application Data

[63] Continuation-in-part of Ser. No. 339,421, Mar. 8, 1973, abandoned.

[51] Int. Cl.[2] ..... D01H 13/14; G07C 3/10

[52] U.S. Cl. ..... 364/552; 235/92 PD; 235/92 QC; 340/526; 364/569

[58] Field of Search ..... 235/151.3, 92 PD, 92 FQ, 235/92 R, 92 PE, 92 CC, 92 QC, 92 CA, 92 TF, 151.1, 151.13, 92 T, 17 T; 178/DIG. 38; 324/181, 186, 140 D, 133; 340/213 Q; 328/120, 148; 364/551, 552, 565, 569

[56] References Cited

U.S. PATENT DOCUMENTS

| | | | |
|---|---|---|---|
| 2,851,596 | 9/1958 | Hilton | 235/92 TF |
| 3,242,320 | 3/1966 | Stout | 235/92 R |
| 3,321,704 | 5/1967 | Mann | 235/92 PD |
| 3,344,350 | 9/1967 | Stoft | 235/151.3 |
| 3,578,960 | 5/1971 | Georgi et al. | 235/92 QC |
| 3,604,904 | 9/1971 | Stiebel et al. | 235/92 PD |
| 3,660,972 | 5/1972 | Neill et al. | 235/92 PD |
| 3,686,484 | 8/1972 | Ciemochowski | 235/92 FQ |
| 3,700,865 | 10/1972 | Ley | 235/151.3 |
| 3,708,750 | 1/1973 | Bucks et al. | 235/92 TF |
| 3,737,633 | 6/1973 | Collineau | 235/92 FQ |
| 3,743,768 | 7/1973 | Copland | 178/DIG. 38 |

*Primary Examiner*—Charles E. Atkinson
*Assistant Examiner*—Errol A. Krass
*Attorney, Agent, or Firm*—Merriam, Marshall & Bicknell

[57] ABSTRACT

This disclosure deals with a system for monitoring the rate of operation of a cyclically operating machine or process or the rate of cyclically recurring events. The system monitors the rate by sensing each cycle occurring during a sampling time interval or duration and generating a signal which is taken as a standard value representing a standard rate. Either the length of time required for a specific number of events is measured, or the number of events occurring in a specified time is measured. The measured value is compared with the standard value and an indication is made of the comparison.

30 Claims, 9 Drawing Figures

135
136
137
138
131
132
133
19
129
118
119
120
128
127
124
122
126
114
115
116
112
113
109
110
106
107
108

MONITORING SYSTEM

This application is a continuation-in-part of our application Ser. No. 339,421, filed Mar. 8, 1973, and now abandoned and entitled Production Monitoring System.

Prior art monitoring systems have been provided for monitoring the production of a machine. For example, the Stout U.S. Pat. No. 3,242,320 discloses a system where the number of operations of a machine is measured over a full day's production run. This measurement is compared with the number of operations if the machine were in continuous operation during the course of the run. The purpose of the Stout system is to measure the amount of "down-time" of the machine, and the system is not designed to measure the rate of operation because, in the Stout system, the rate would either be 100% or 0%, depending upon whether or not the machine were operating. The Stout system therefore is not designed to measure the rate of operation of a variable rate machine.

Other monitoring systems have been provided to measure or monitor the rate of output of a process by measuring the output and measuring the input, and then comparing these values in order to determine losses within the system. Again, such a system is not capable of measuring a variable rate over a relatively short time interval.

When considering a machine which may be operated at different rates, such as a manually operated plastics molding machine where the operator is required to perform certain functions, it is important to be able to determine the rate at which the machine is being operated. This is important, first of all, as a check on the efficiency of the operator, and, secondly, because the rate of operation of a machine is often an indication of whether or not the machine is wearing out.

It is therefore a general object of the present invention to provide a monitoring system for measuring or sampling the rate of occurrence of events in a cyclically recurring series of said events, comprising first means connected to respond to said events and generating a first signal representing a number of the occurrences of said events, second means for generating a second signal representing a sampling time interval, third means providing a standard value of comparison representing a predetermined rate of occurrence of said events, one of said first and second signals being variable as a function of the rate of said events while the other of said first and second signals is held constant, and fourth means for comparing said variable signal with said standard value and for providing an indication of said comparison.

In a preferred form of the invention, during each rate sampling the time required for a specified number of events is measured and the measured time is compared with a standard value of time. In an alternate form, the number of events occurring in a specified time is measured, and the measured number of events is compared with a standard number of events.

The foregoing and other objects and advantages of the present invention will be better understood from the following detailed description taken in conjunction with the accompanying figures of the drawings, wherein.

Figure 4:
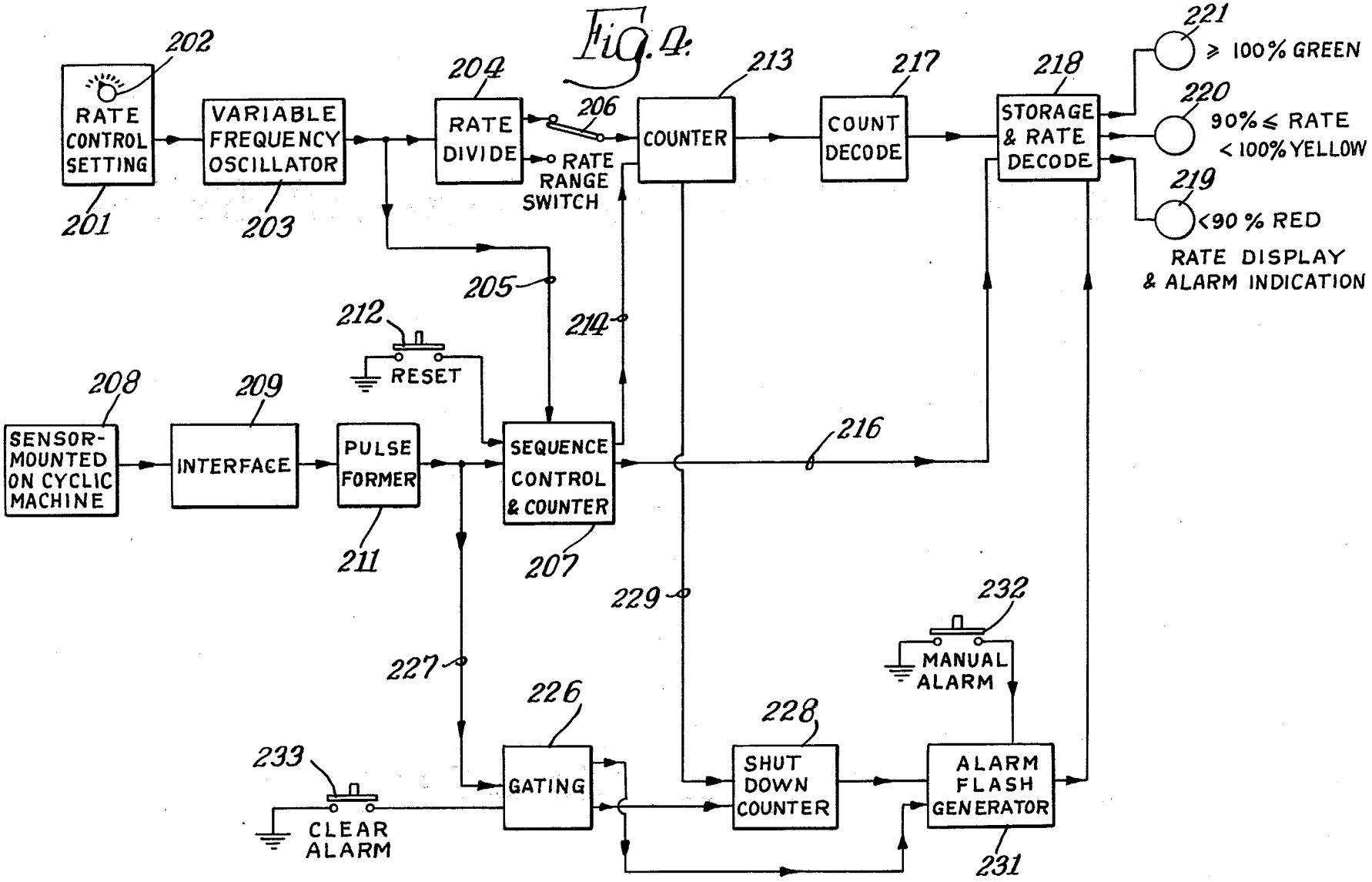
FIG. 4 is a block diagram of an alternate preferred form of monitoring system in accordance with the present invention.
Figure 5A:
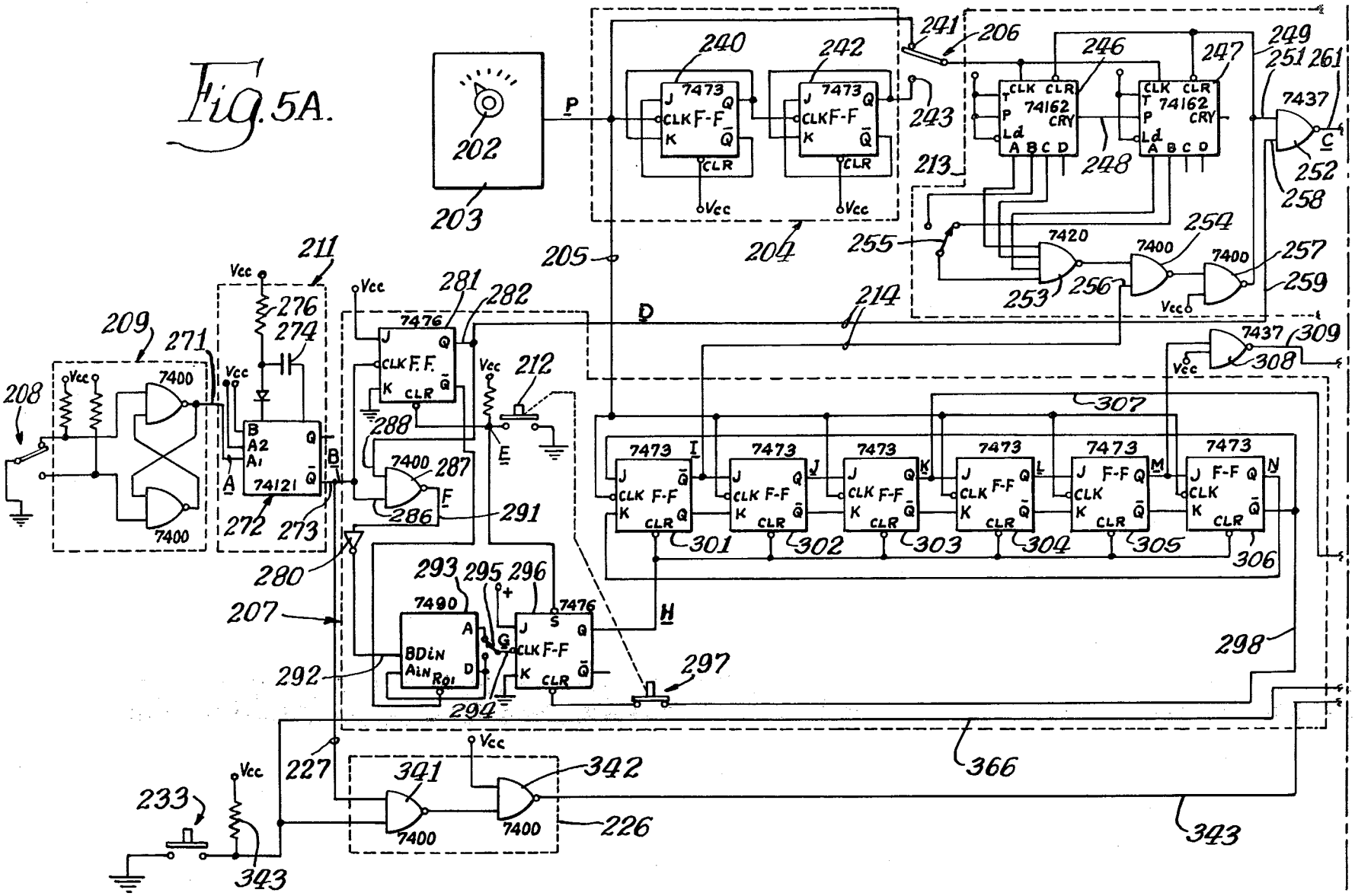
Figure 5B:
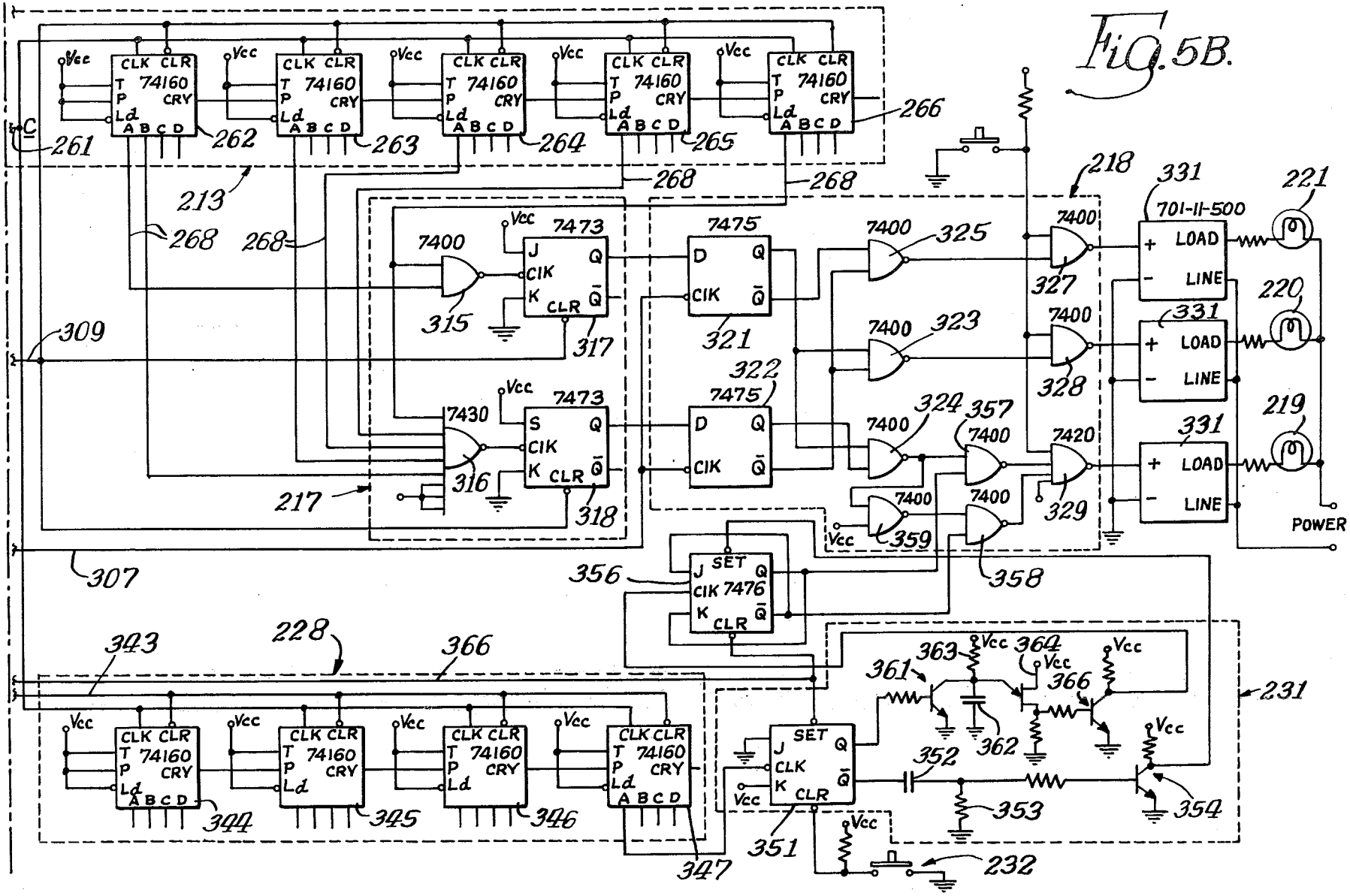
Figure 6:
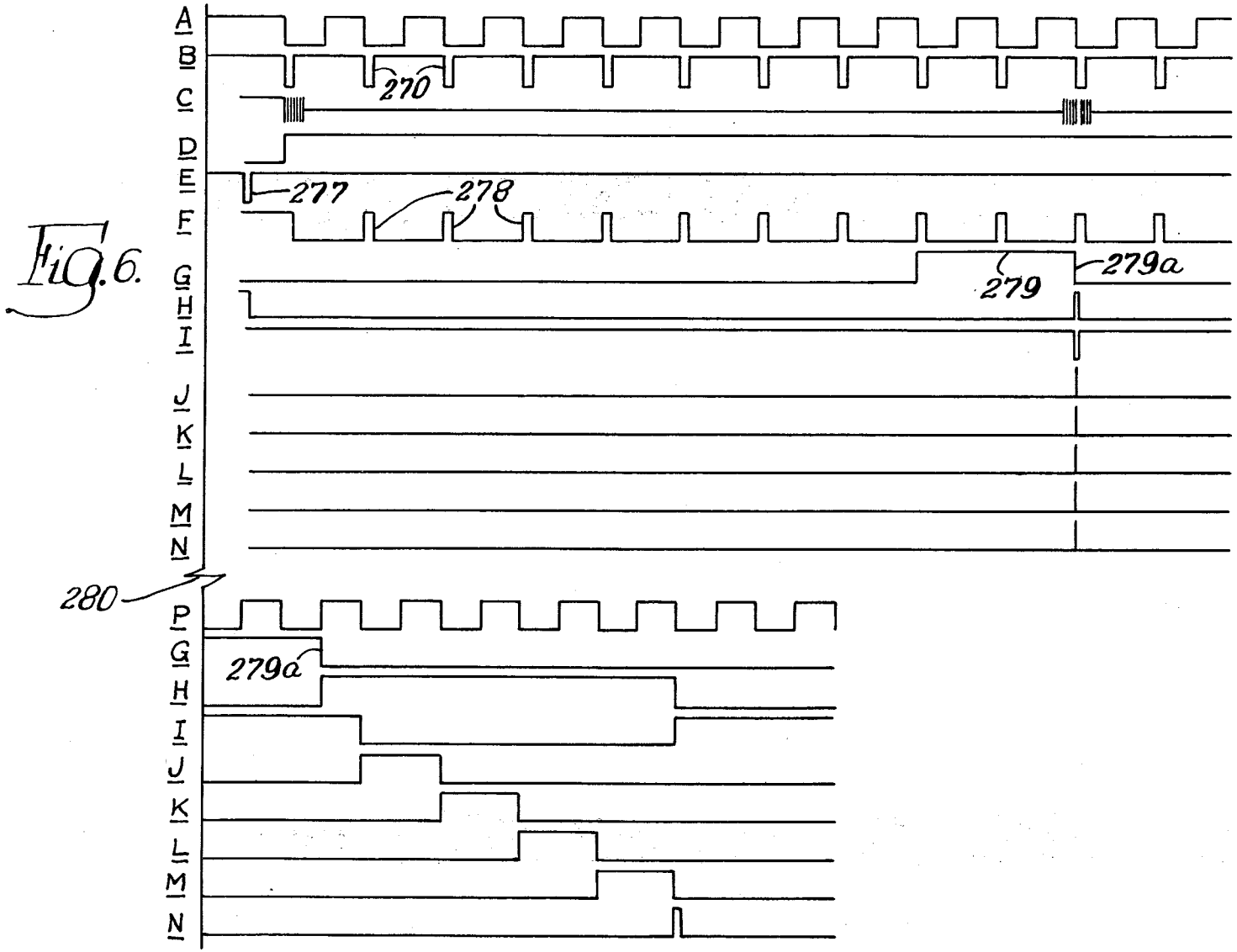
Figure 7:
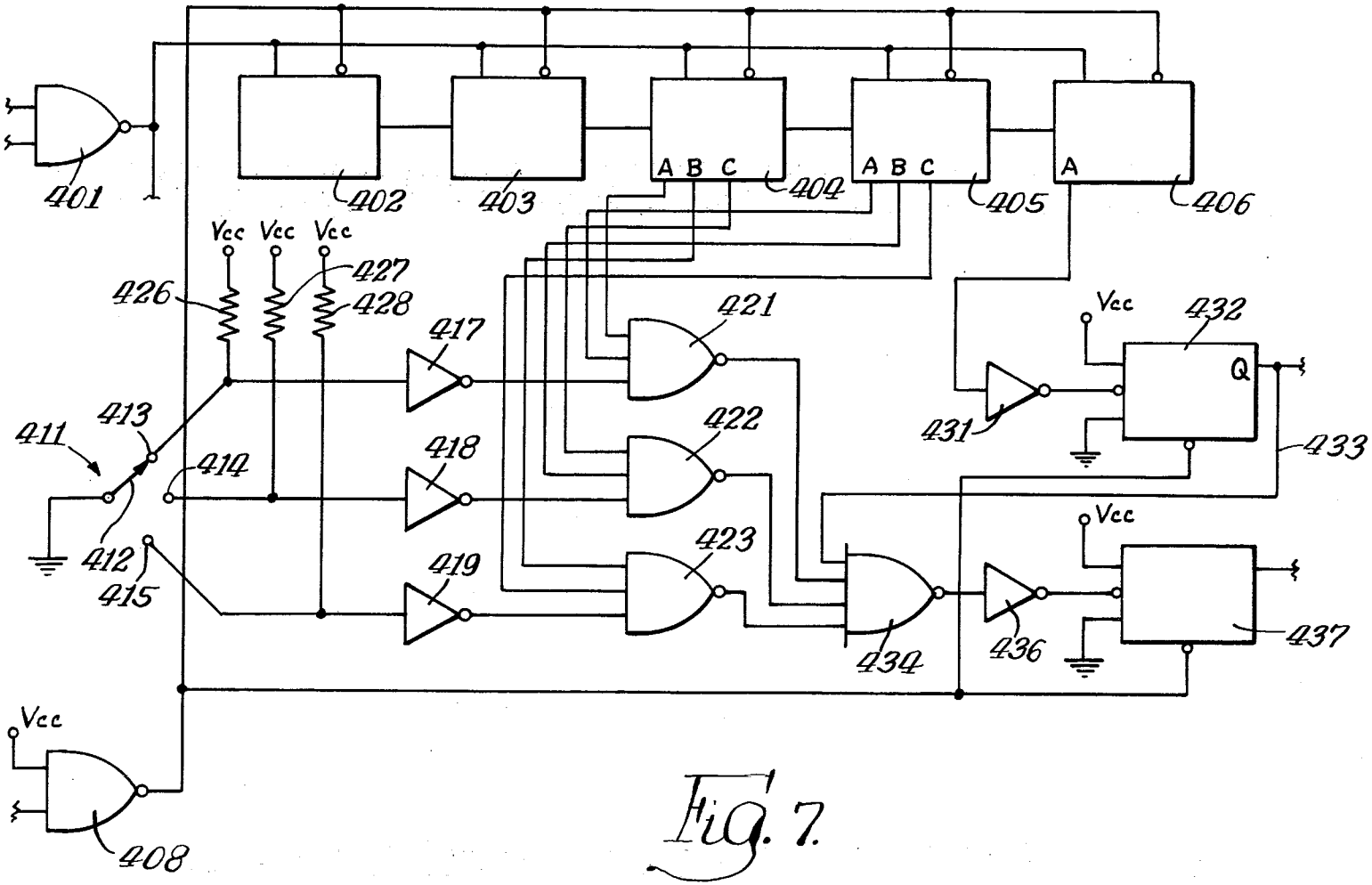
Figure 8:
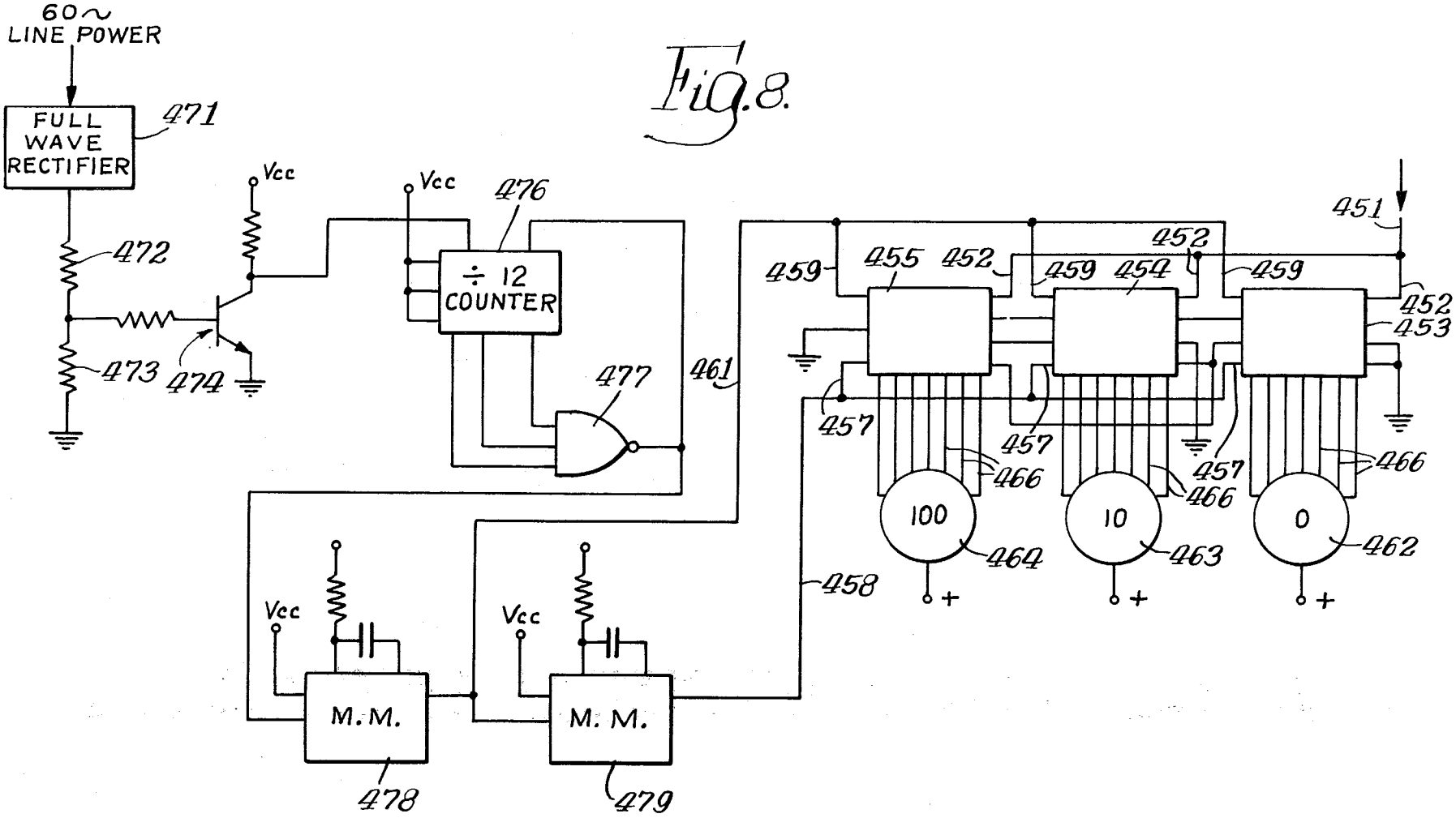

FIGS. 5*a* and 5*b* are schematic diagrams of the form of FIG. 4;

FIG. 6 is a timing chart for the form of FIG. 4;

FIG. 7 is a schematic diagram of an alternate form of a part of the system shown in FIGS. 5*a* and 5*b;* and FIG. 8 is a schematic diagram of an alternate form of another part of the system shown in FIGS. 5*a* and 5*b*.

Figure 1:
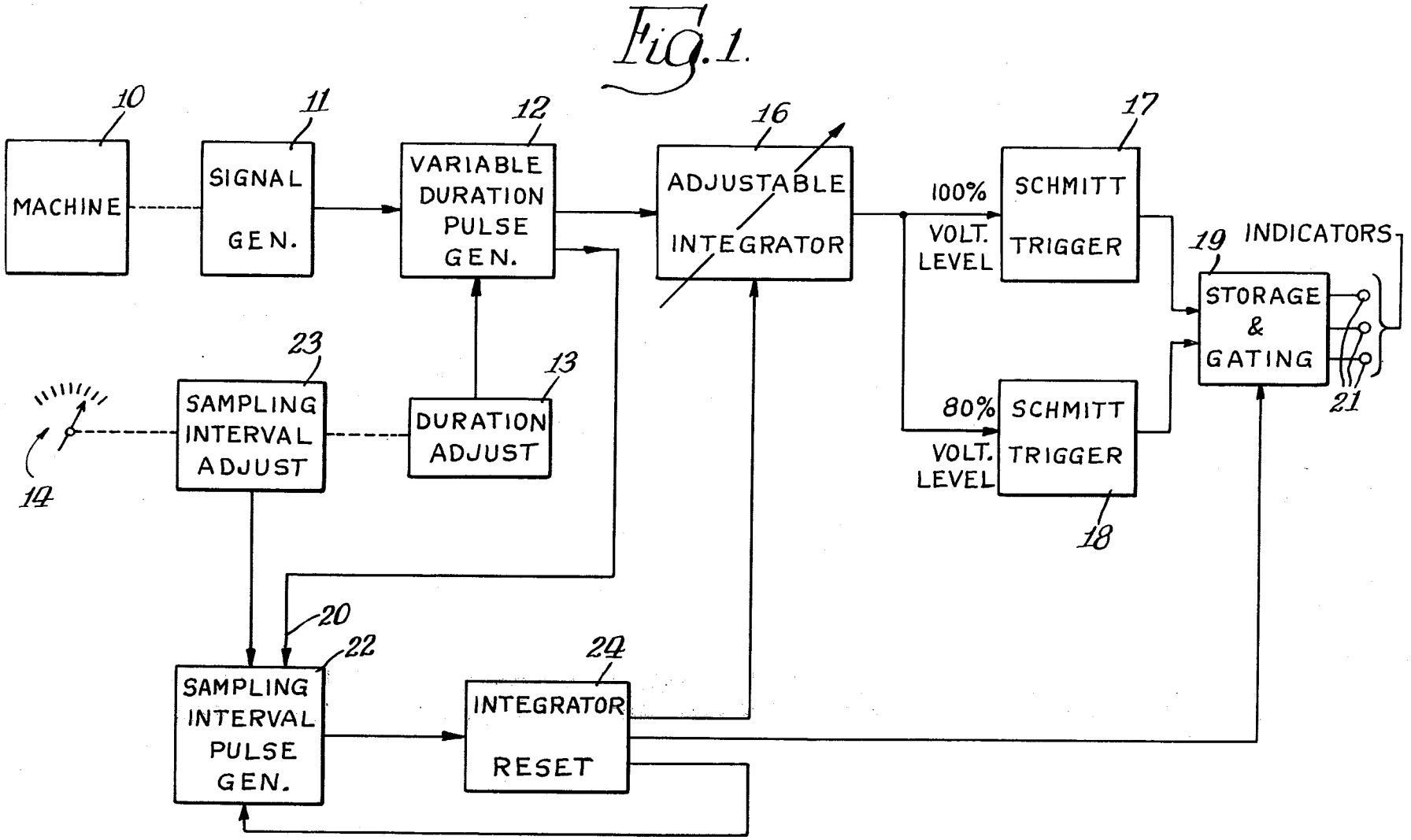
FIG. 1 is a block diagram of a monitoring system in accordance with the present invention.

With reference to the block diagram of FIG. 1, the reference numeral 10 represents a cyclically operated machine or process whose rate of operation is to be monitored. It should be understood that the machine 10 may be any conventional machine or process, or any cyclically recurring series of events, and does not form part of the present invention. A signal generator 11 is coupled to the machine 10 and generates an electric signal for each cycle of operation of the machine. The coupling between the machine 10 and the signal generator 11 may, for example, be a mechanical coupling, an optical coupling, a magnetic coupling, etc. It should also be understood that while the system disclosed and claimed herein is described in terms of electronic components and electrical signals, a corresponding system using fluidic devices and signals may also be used.

To obtain an indication of the rate of operation of the machine, a measurement may be taken either of the number of cycles of operation occurring during a sampling interval, or of the time duration between cycles. In either approach, machine cycles are sensed and a standard time interval is generated or developed, and a ratio is obtained between cycles and a unit of time. In the present example of FIG. 1, the system senses the number of cycles occurring in a sampling time interval, but it should be understood that the other mentioned approach could be taken. Further, while the system may employ exclusively either analog or digital circuits, in the form of the invention illustrated and described in FIG. 1, a combination of analog and digital circuits are used.

The signals from the generator 11, one signal being generated for each machine cycle as previously mentioned, are fed to a variable duration pulse generator 12 which generates one pulse for each signal received from the generator 11. The time duration of each pulse from the generator 12 is adjustable however, such adjustment being accomplished by a circuit 13 and a manually controlled dial 14 which is coupled to the circuit 13. The pulses from the generator 12 are fed to an adjustable integrator circuit 16 which totals the pulses received from the generator 12 and produces a voltage at the output thereof having a magnitude which is a function of the number of pulses received from the generator 12 and a standard rate to be described. As will be explained hereinafter, the time duration of each pulse is a function of the length of the sampling interval, and the adjustment of the integrator circuit 16 is a function of the standard rate. Each pulse from the generator 12 increases the magnitude of the voltage at the output of the integrator 16 and, at the end of each pulse, the integrator 16 holds the voltage level it has attained. Consequently, the voltage level appearing at the output of the integrator 16 is representative both of the number of pulses received by it from the beginning of a sampling interval and of the standard rate over the time duration of each pulse. At the end of a sampling interval, which may be adjusted as will be explained hereinafter, the integrator 16 is reset and starts a new count in the next subsequent sampling interval.

Connected to the output of the integrator 16 are two Schmitt trigger circuits 17 and 18. The trigger circuit 17 is triggered when the voltage level appearing at its input is at least as great as a standard value of voltage such as 12 volts. The second trigger circuit 18 is constructed to be triggered when the voltage at its input is at least as great as 9.6 volts, for example. If 12 volts represents 100% of rated or desired operation, 9.6 volts represents 80% of such operation. Thus, the two trigger circuits 17 and 18 serve as a voltage level comparison device with the voltages at which they are triggered being taken as standard voltages.

The outputs of the two trigger circuits 17 and 18 are connected to a storage and gating circuit 19 which stores the outputs of the trigger circuits 17 and 18 and activates a plurality of indicators 21 until the end of a subsequent sampling interval, at which time the indicators are reset and the subsequent voltage comparison is stored in the circuit 19, the proper indicator 21 is selected by the circuit 19, and the indicator is activated. As will be described hereinafter, the gating circuit 19 and the indicators 21 may for example be arranged to indicate whether the rate of operation of the machine is 100% or more of desired operation, whether it is between 80% and 100%, whether it is under 80%, or whether the machine is not running.

The system illustrated in FIG. 1 further includes a sampling interval pulse generator 22 which has an input 20 connected to an output of the pulse generator 12. A pulse out of the generator 12 activates the generator 22 to generate a pulse after a preselected time interval, and then turns itself off. After being turned off, the next subsequent pulse from the generator 12 will again activate the generator 22, and the foregoing cycle of events is continuously repeated. A selection of the duration of the time interval is made by an adjustment circuit 23 which is also connected to the dial 14 and is adjusted by the dial 14 simultaneously with an adjustment of the circuit 13. The pulses produced by the pulse generator 22 activate an integrator reset circuit 24 which is connected to the integrator circuit 16 and resets the integrator at the end of each sampling interval as previously mentioned. The reset circuit 24 is also connected to the storage and gating circuit 19 in order to reset the storage and gating circuits 19 which activate the indicators 21, as will be subsequently explained. Further, another output of the circuit 24 is connected to an input of the generator 22 and turns off the generator 22 at the end of each sampling interval.

Briefly, the signal generator 11 provides a train of pulses at a repetition rate that is a function of the rate of operation of the machine 10. Prior to starting the system in operation, the dial 14 is adjusted to select a sampling interval over which the machine operation rate is to be monitored, and the adjustment circuit 13 sets the pulse generator 12 to produce a pulse for each pulse from the generator 11, having a time duration which is a function of the sampling interval selected. The integrator circuit 16 totals the areas under the pulses, and an adjustment in the integrator circuit 16 permits an adjustment of the slope of the voltage ramp between the voltage level changes, each ramp being produced by a pulse from the generator 12. The magnitude of the integrator 16 output voltage is a function of the pulse duration, the pulse amplitude, and an adjustable weighting function to be discussed hereinafter.

The magnitude of the voltage at the integrator 16 output increases as it receives pulses, and it triggers the Schmitt trigger 18 when, and if, the voltage reaches 80%, or 9.6 volts, of the standard value. If the rate of operation reaches 100%, the Schmitt trigger 17 is also triggered. At the end of the sampling interval, as set by the dial 14, a reset pulse is generated by the circuit 24 which resets the integrator circuit 16. The information from the two trigger circuits 17 and 18 is transferred to the circuit 19 to energize one or more of the indicators 21.

As will be explained hereinafter, an adjustment of the dial 14 adjusts both the time duration from activation of the generator 22 until a pulse from the generator 22 is provided, and also the time duration of the pulses from the generator 12. The time durations vary in an inverse manner so that the voltage level from the integrator circuit 16 will indicate the same rate of operation regardless of the length of time of the sampling interval. The adjustment in the integrator 16 is an adjustment of the slope of the ramp of the output voltage and this is necessary to permit the system to be used with machines having different rates of operation. The foregoing adjustments will be discussed in greater detail in connection with FIG. 2.

Figure 2:
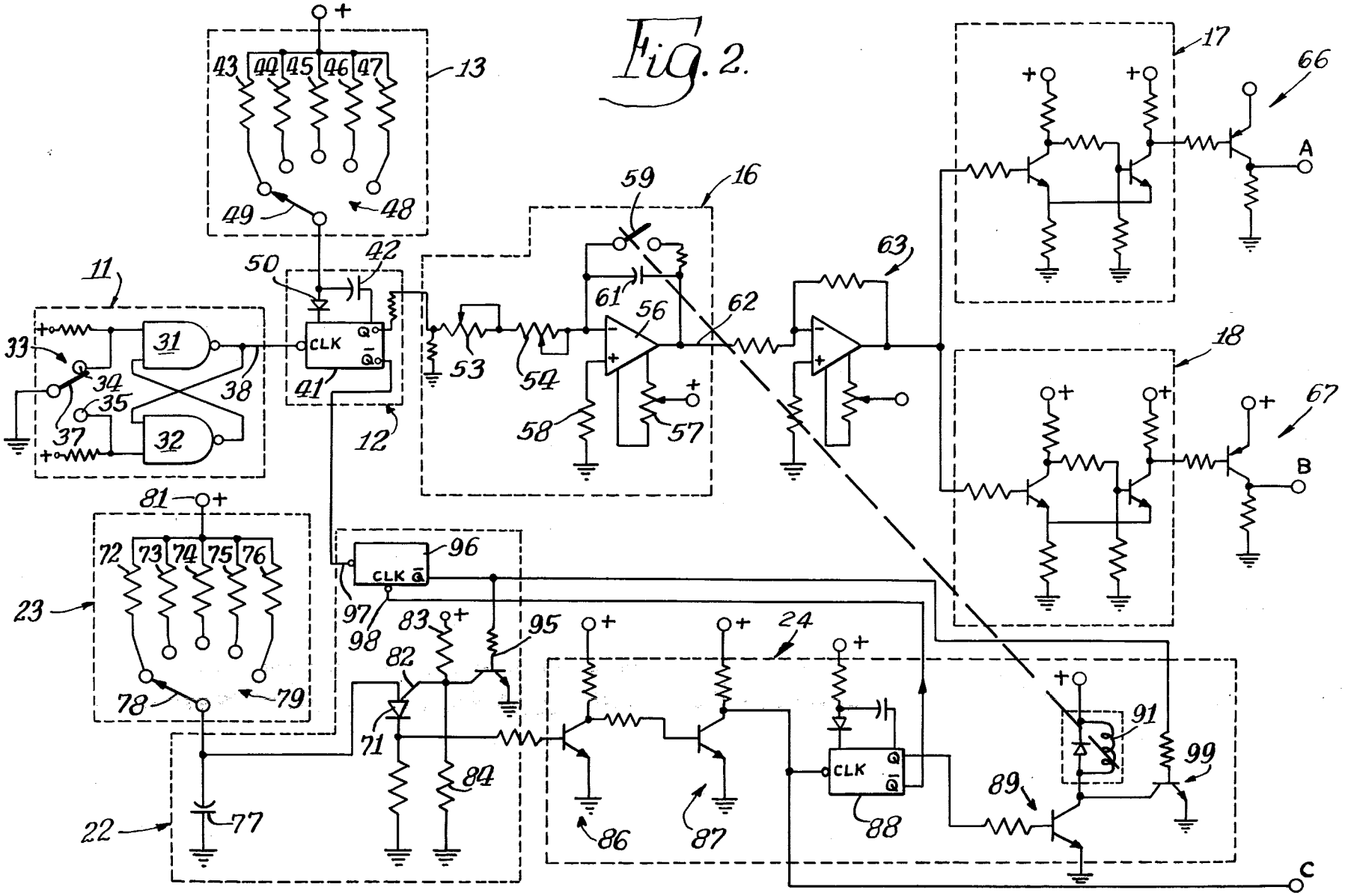
FIG. 2 is a schematic diagram of a portion of the monitoring system shown in FIG. 1.

With reference to FIG. 2, the signal generator 11 includes an interface circuit comprising two NAND gates 31 and 32 which are connected to form a set-reset flip-flop circuit. The inputs to the two NAND gates 31 and 32 are connected to a switch 33 including two fixed contacts 34 and 35 and a movable contact 37. While the switch 33 is shown as being a mechanical switch, it should be understood, as previously mentioned, that other non-mechanical types of switches could be used. The movable contact 37 is connected to be operated by the machine 10 such that, in each operating cycle of the machine, the movable contact 37 moves to the contact 35 and then returns to the other contact 34. Such movement of the contact 37 results in a signal on the output conductor 38, one such signal being generated for each operating cycle of the machine. In the present example, this output signal is at a high voltage level when the contact 37 is at the contact 34 and is at a lower voltage when the contact 37 is at the contact 35.

The conductor 38 is connected to the input of a monostable multivibrator 41 of the variable duration pulse generating circuit 12. The multivibrator 41 includes a timing capacitor 42 and a bank of five resistors 43 to 47 which are part of the circuit 13. A manually operable switch 48 having a movable contact 49 is provided to selectively connect one of the five resistors 43 to 47 into circuit with the remainder of the multivibrator 41. For large values of the capacitor 42, a diode 50 is preferably also connected in the multivibrator circuit. Each time a signal appears on the line 38, the monostable multivibrator 41 switches to its unstable state, and the length of its timing period is determined by the size of the timing capacitor 42 and the size of the selected resistor 43 to 47. In the present example, the resistor 43 is relatively large and the other resistors 44 to 47 progressively decrease in size. With the large resistor 43 connected in the circuit, the timing period of the multivibrator is relatively long and the timing period progressively decreases with decreasing size of the selected resistor. In the present example, the capacitor 42 is 600

μf and the resistors 43 to 47 are respectively 36K, 18K, 17K, 8.2K and 6.2K ohms.

The Q output of the monostable multivibrator 41 is connected to the first of two series connected potentiometers 53 and 54 which form part of the adjustable integrator 16. The potentiometer 53 is an internal calibration potentiometer and is mounted internally of the circuit, whereas the potentiometer 54 is an external calibrating potentiometer which would normally be mounted on the panel of the system where it may be manually adjusted. The integrator circuit 16 further includes an operational amplifier 56, the second potentiometer 54 being connected to the negative input of this amplifier. Another calibration potentiometer 57 is provided in the amplifier circuit 56, and a resistor 58 connects the positive amplifier input to ground. Normally open relay contacts 59 are connected between the negative input and the output of the amplifier 56 and a capacitor 61 is connected across the contacts 59. Each pulse input to the integrator 16 results in a charge being placed on the capacitor 61, the capacitor 61 holding the charge until the relay contacts 59 are closed at which time the capacitor 61 is discharged.

The output of the integrator circuit 16 appears on a conductor 62 which is connected through a unity voltage gain buffer amplifier 63 to the input of the two Schmitt trigger circuits 17 and 18. The buffer amplifier 63 both prevents the integrator 16 from being loaded down and it reverses the polarity of the signal. The output of the integrator 16 is a downwardly decreasing ramp voltage, while the output of the amplifier 16 is an upwardly increasing ramp voltage.

The Schmitt trigger circuit 17 is designed to be triggered when the voltage output of the amplifier 63 is, in the present example, 12 volts DC or more. The other trigger circuit 18 is designed to be triggered when the voltage level out of the amplifier 63 is 9.6 volts or more.

The outputs of the two trigger circuits 17 and 18 are respectively connected to two amplifier circuits 66 and 67 which convert the voltage level out of the Schmitt trigger circuits to levels appropriate for operating the storage and gating circuits 19, and they also amplify the voltage differential or pulse height of the output signals of the trigger circuits 17 and 18. The outputs of the two amplifier circuits 66 and 67 are fed to the storage and gating circuits 19 as previously explained in order to energize the indicators 21, and the operation of this portion of the circuit will be described in greater detail hereinafter in connection with FIG. 3.

The sampling interval pulse generator 22 and the integrator reset circuit 24 are designed to enable an operator of the system to select the length of the sampling interval over which the rate is to be measured. The circuit 22 comprises an oscillator which, in the present instance, is a relaxation type including an SCR 71 having its anode connected to a second bank of resistors 72, 73, 74, 75 and 76 of the circuit 23. A capacitor 77 is connected to the movable contact 78 of a multiple position selector switch 79, the fixed contacts of the switch being connected to the resistors of the bank 72. The resistors, the switch 79 and the capacitor 77 are connected in series between a positive potential 81 and ground, and the SCR 71 is connected between the capacitor 77 and the resistors. The gate 82 of the SCR 71 is connected to a voltage divider including two resistors 83 and 84 to provide a fixed bias on the gate 82.

The generator 22 further includes a synchronization circuit for initiating a sampling interval with the receipt of a pulse from the circuit 11. Such synchronization is important because it prevents random initiation of a sampling interval, which could result in a counting error amounting to one generator 11 pulse. The synchronization circuit includes a transistor 95 which has its collector connected to the gate 82 of the SCR 71 and its emitter connected to ground. The base of transistor 95 is connected to the $\overline{Q}$ output of a flip-flop 96. When the transistor 95 is biased on, the gate 82 is pulled to ground potential and the SCR 71 is continuously turned on, thus rendering the oscillator inoperative. An input 97 of the flip-flop 96 is connected to the $\overline{Q}$ output of the multivibrator 41. Assuming that the $\overline{Q}$ output of the flip-flop 96 is initially high, the transistor 95 is on and the oscillator is inoperative. The leading edge of a machine generated pulse on the conductor 38 triggers the multivibrator 41 and its $\overline{Q}$ output falls, thus setting the flip-flop 96. Its $\overline{Q}$ output also falls and turns off transistor 95, thereby actuating the relaxation oscillator. During the sampling interval, subsequent machine generated pulses have no affect on the flip-flop 96 and the remainder of the circuit 22. At the end of the sampling interval, another multivibrator 88 generates a pulse which is connected to the clock input 98 of the flip-flop 96 and resets the flip-flop 96. This action turns the transistor 95 on again to de-activate the oscillator until the next subsequent machine generated pulse appears.

In the operation of the oscillator circuit, when the transistor 95 is turned off, the capacitor 77 is gradually charged through the selected resistor 72 to 76 until the charge on the capacitor 77 is great enough to turn on the SCR 71. When the SCR 71 fires, the capacitor 77 discharges through the SCR until the extinguishing voltage of the SCR 71 is reached, at which time the SCR 71 ceases to conduct. The transistor 95 is then turned on until the next machine generated pulse turns it off. The capacitor 77 then again begins charging to repeat the cycle. Depending upon the size of the selected resistor 72 to 76, the time period of the sampling interval may be varied.

At the end of, for example, a three-minute time interval, the circuit 22 will generate a pulse when the capacitor 77 discharges through the SCR 71. This pulse of course has a relatively short time duration, and it is both amplified and twice inverted by two amplifier circuits 86 and 87. The negative going trailing edge of the pulse output of the amplifier circuit 87 is connected to trigger the multivibrator circuit 88 of the integrator reset circuit 24. The multivibrator circuit 88 provides a fixed width output pulse for each pulse received from the circuit 22, and the output pulse is connected to the base of a transistor 89 which has its collector connected to a relay coil 91. The coil 91 actuates the relay contacts 59 previously described, and each time the relay coil 91 is energized, due to a pulse from the multivibrator 88, the contacts 59 close and discharge the capacitor 61. Also connected to the collector of the transistor 89 is the collector of another transistor 99 which has its emitter connected to ground. The base of the transistor 99 is connected to the $\overline{Q}$ output of the flip-flop 96, and when the transistor 99 is on, the coil 91 is continuously energized. Since both transistors 95 and 99 are controlled by the $\overline{Q}$ output of the flip-flop 96, both transistors will be turned on at the same time. Consequently, when the circuit 22 is activated, the contacts 59 will open, and the integrator circuit 16 will start operating simultaneously with the initiation of a sampling interval. During the time that the circuit 22 is de-activated, the contacts 59 are closed and thus de-activate the integrator 16.

In addition, the amplifier 87 output is also connected two terminals C and 108, which connect to the storage and gating circuits 19, as will be discussed hereinafter.

Considering the operation of the portion of the system described thus far, assume that the operator of the system sets the dial 14 to a position where the system will measure the rate of operation of the machine 10 over a three minute sampling interval. Upon the receipt of a machine-generated pulse, the oscillator of the circuit 22 begins its timing period and during this period the pulses from the signal generator 11 are fed to the variable duration pulse generator 12. Each pulse of the generator 12 has a time duration which is determined by the setting of the switch 48. The pulses from the generator 11 are fed to the integrator 16 and place a charge on the capacitor 61 for each pulse. The amount of the charge placed on the capacitor 61 by each pulse depends upon the magnitude and the time duration of the pulse, and upon the setting of the two potentiometers 53 and 54. The potentiometer 54 is adjusted by the operator prior to operation to place a certain amount of charge on the capacitor 61 for each input pulse, the setting of the potentiometer 54 being determined by the rate of the machine 10 which is to be taken as the standard or desired value. The voltage Vo at the output 62 of the integrator circuit 16 may be derived from the equation $$V_o = \frac{-1}{RC} \int_{t_1}^{t_2} V_{in}\, dt \qquad (1)$$

$$= \frac{-1}{RC} V_{in}\, t \qquad (2)$$

where

R is the resistance in ohms of the two potentiometers 53 and 54

C is the capacitance in farads of the capacitor 61

$V_{in}$ is the input pulse amplitude, and t is the input pulse width in seconds.

The values C and $V_{in}$ are fixed, and therefore $V_o$ depends upon R and t. As previously mentioned, t may be varied by the switch 48, and R is set by the operator using the potentiometer 54. The value RC may be considered a weighting factor, and it determines how much charge will be placed on the capacitor 61 for an input pulse having a given height and width.

The integrator voltage is amplified by the amplifier 61 and appears at the inputs of the triggers 17 and 18, and if the rate of operation of the machine 10 is sufficiently high, the voltage at the input of the circuit 18 will reach 9.6 volts, resulting in triggering the circuit 18. If the rate of operation of the machine during the sampling interval is 100% of the rated or standard value, the voltage at the input of the trigger circuit 17 reaches 12 volts resulting in triggering of both of the trigger circuits 17 and 18. At the end of the sampling interval, the multivibrator 88 generates an output pulse causing the relay coil 91 to close the contacts 59 and discharge the capacitor 61, and the contacts 59 remain closed until the beginning of a new sampling interval.

The foregoing discussion has assumed that the operator wishes to sample the rate of operation of the machine 10 over a three-minute time interval. If however the operator wishes to sample the machine rate over a different time interval, such as six minutes, he adjusts the dial 14 to move the contact 78 to second resistor 73 and, simultaneously, the movable contact 49 of the switch 48 to the resistor 44. The value of the second resistor 73 is greater than the value of the resistor 72 initially selected, and consequently twice the length of time is required for the capacitor 77 to charge to the point where the SCR 71 triggers. Therefore, the sampling interval is twice as long. Since the voltage values at which the two Schmitt trigger circuits 17 and 18 are triggered remain the same, however, it is also necessary to change the rate at which the capacitor 61 is charged in order to reach the same voltage level at the end of the longer sampling interval, assuming that the rate of operation of the machine is the same. This is done by changing the width or time duration of the pulses generated by the generator 12. As previously mentioned, turning of the dial 14 sets the switch 48 to connect the second resistor 44 in the multivibrator 41 circuit, and the second resistor 44 has a smaller value than the resistor 43. This change in resistor values changes the timing period of the multivibrator and therefore the time duration of the output pulses. Consequently, even though the sampling interval may be doubled, if the rate of operation of the machine remains constant, the voltage magnitude fed to the trigger circuits 17 and 18 will be the same because the capacitor 61 will be charged by a smaller amount by each pulse.

It will be apparent therefore that different sampling intervals may be selected by the operator using the dial 14 without any adjustment of the voltages at which the two trigger circuits 17 and 18 are triggered.

In the example being described herein, 12 volts has been taken as indicating 100% of the rated value of the machine and 9.6 volts has been taken as 80% of rated value. If the monitoring system were used with a machine having a rated value of 10 cycles of operation per minute, the potentiometer 54 is adjusted by the operator to set the weighting factor to cause the voltage at the input of the two trigger circuits 17 and 18 to be 12 volts after 30 pulses have been generated by the circuit 12, assuming a three minute sampling interval. If the same machine were later modified, or if a different operator were using the machine, so that the rated value of the machine were 12 cycles per minute, the potentiometer 54 would be adjusted by the operator to result in a voltage of 12 volts appearing at the inputs of the trigger circuits 17 and 18 after 36 pulses have been received by the integrator circuit 16, again assuming a three minute sampling time duration. The adjustment of the potentiometer 54 results in a change in the weighting factor or the rate at which the capacitor 61 is charged during the presence of a pulse received from the circuit 12. The voltage output wave form of the circuit 16 resembles a downwardly increasing voltage having a slope or ramp angle that is determined by the setting of the potentiometer 54. Between the ramps, the voltage across the capacitor 61 is held constant.

Instead of adjusting the potentiometer 54 to change the rated value, or cycles per minute, of the machine, the voltage magnitudes at which the trigger circuits 17 and 18 are tripped may be changed. This may be accomplished, for example, by providing voltage dividers connected to the transistors of the Schmitt trigger circuits 17 and 18, to permit a selection of the voltages at which they are triggered. Of course, voltage magnitude responsive trigger circuits other than Schmitt triggers could be used for this purpose.

Figure 3:
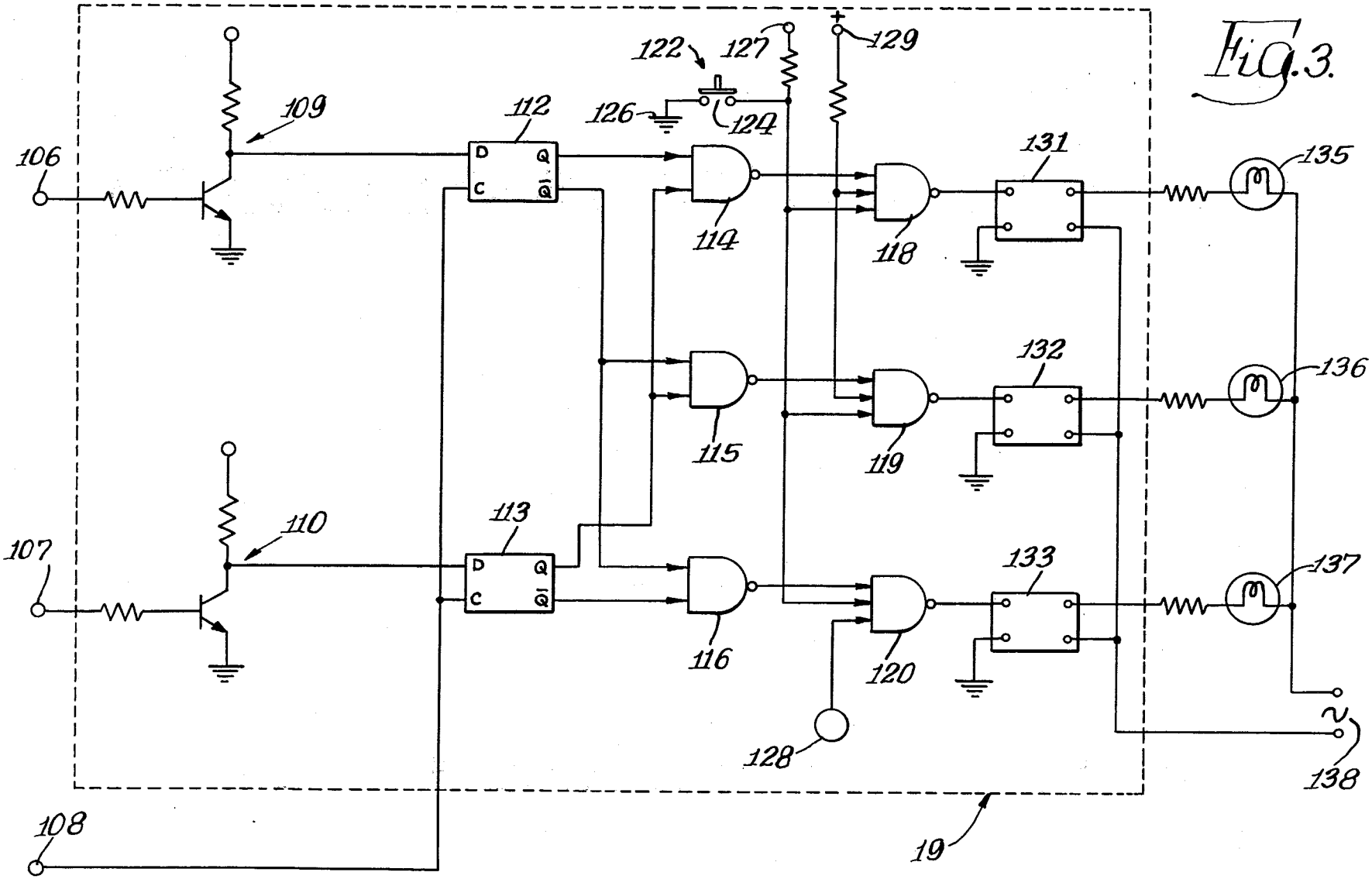
FIG. 3 is a schematic diagram of the remainder of the system shown in FIG. 1.

FIG. 3 illustrates in detail the storage and gating circuit 19. The terminal A (FIG. 2) is connected to the terminal 106 (FIG. 3), the terminal B is connected to the terminal 107, and the terminal C is connected to the terminal 108 in FIG. 3. The terminals 106 and 107 are respectively connected to the inputs of two amplifier circuits 109 and 110 which invert the signals appearing on the terminals 106 and 107. The output of the amplifier 109 is connected to the D input of a flip-flop 112, and the output of the amplifier 110 is connected to the D input of another flip-flop 113. The terminal 108 is connected to the C inputs of both flip-flops 112 and 113.

Three NAND gates 114, 115 and 116 are connected to the outputs of the flip-flops 112 and 113. The NAND gate 114 has two inputs respectively connected to the Q outputs of the two flip-flops 112 and 113, the NAND gate 116 has two inputs respectively connected to the $\overline{Q}$ outputs of the flip-flops 112 and 113, and the NAND gate 115 has one input connected to the $\overline{Q}$ output of the flip-flop 112 and another input connected to the Q output of the flip-flop 113. The NAND gates 114 to 116, and the three NAND gates 118, 119 and 120 connected to the outputs of the gates 114 to 116 operate such that high signals on both inputs produce a low output whereas two low inputs or one low and one high input will produce a high output.

The NAND gate 118 has one input connected to the output of the gate 114 and a second input connected to a "push-to-test" circuit 122. Similarly, the gate 119 has an input connected to the output of the gate 115 and another input connected to the circuit 122, and the gate 120 has an input connected to the output of the gate 116 and another input connected to the circuit 122. The "push-to-test" circuit 122 includes a manually operable push button switch 124 which, when closed, connects the associated gate inputs to a low or ground potential indicated by the numeral 126. When the switch 124 is open, the associated gate inputs are connected to a high or positive potential, indicated by the numeral 127.

If desired, a third input of the gate 120 may be connected to a circuit 128 which is designed to sense complete inoperativeness of the machine being monitored. The circuit 128 may operate such that, when the machine is inoperative, the circuit 128 alternately produces high and low signals. Similar third inputs of the gates 118 and 119 are connected to a high potential indicated by the numeral 129.

The outputs of the three gates 118 to 120 are respectively connected to three circuits 131, 132 and 133 which control energization of three lamps 135, 136 and 137. One side of each lamp is connected directly to a power supply indicated by the numeral 138 whereas the other side of each lamp is connected to an output of the associated circuit 131 to 133. Another output of each circuit 131 through 133 is also connected to the power supply 138. Each of the circuits 131 to 133 operates similar to a relay. A high signal received from its associated NAND gate closes the circuit through the associated lamp and the power supply 138 in order to light or activate the associated lamp.

Considering the operation of the storage and gating circuit 19, assume that the machine being monitored is operating at less than 80% of the standard or rated value. In these circumstances, the voltage appearing at the inputs of the two Schmitt trigger circuits 17 and 18 will not have a magnitude great enough to trigger the two circuits 17 and 18. The output voltages of the two circuits 17 and 18 will therefore be at a relatively low value, and since the circuits 66, 67, 109 and 110 invert the voltages, there will be two inversions of the output of each Schmitt trigger. Consequently, if the outputs of the two Schmitt triggers are both low, low signals will also appear at the D inputs of both flip-flops 112 and 113.

At the end of a sampling interval, a positive going pulse appears at the terminal 108, and this pulse causes the information appearing at the D inputs of the two flip-flops 112 and 113 to appear at their outputs. The Q outputs of both flip-flops will then be low and the $\overline{Q}$ outputs will both be high. Regarding the NAND gates 114 to 116, the gate 114 will have a low and a high input and therefore a high output, the gate 115 will also have a low and a high input and therefore a high output, and the gate 116 will have two high inputs and therefore a low output.

Regarding the three NAND gates 118 to 120, the switch 124 will be open during monitoring operation of the system, and assuming that the machine is operating at less than 80% of rated value as previously mentioned, the gate 118 will have three high inputs and a low output, the gate 119 will have three high inputs and a low output, and the gate 120 will have a low and two high inputs and therefore a high output.

As previously mentioned, the circuits 131 to 133 will activate the associated lamps 135 through 137 only upon the receipt of a high input. Therefore, the high input to the circuit 133 will turn on the lamp 137 and the lamps 135 and 137 will be off. The lamp 137 may, for example, produce a red light indicating that the machine is operating at less than 80% of rated value during the previous sampling interval.

If, during the subsequent sampling interval, the rate of operation of the machine has increased to the point where it is operating at between 80% and 100% of rated value, at the end of a sampling interval, the signal at the D input of the flip-flop 113 will be high whereas the signal at the D input of the flip-flop 112 will continue to be low. Without discussing in detail the operation of the switching circuit, in these circumstances a high input will appear at the input of the circuit 132 and the lamp 136 will be energized. The lamps 135 and 137 will be off. If desired, the lamp 136 may be colored yellow to indicate that the machine is operating in the 80% to 100% range.

If during the next subsequent sampling interval the rate of operation of the machine increases even further to the point where it is at or above 100% of rated value, the signals at the D inputs of both flip-flops 112 and 113 will be high. Again, without discussing the gating circuit operation in detail, the input only to the circuit 131 will be high and only the lamp 135 will be on. The lamp 135 may be colored green to indicate that the machine is operating at at least 100% of rated value.

If at any time it is desired to test the operativeness of the three lamps 135 to 137, the switch 124 may be manually closed to produce a low signal input to the three gates 118 to 120. Such a low input produces high outputs from the circuits 118 to 120 which, if the three lamps 135 through 137 are operating properly, will activate the three lamps.

It will be apparent therefore that, at the end of each sampling interval, the pulse appearing at the terminal 108 transfers the information derived from the voltage comparator circuits, comprising the two Schmitt trigger circuits 17 and 18, to the storage and gating circuits, and the comparison is stored and certain of the lamps 135 through 137 are activated during the next subsequent sampling interval. At the end of the next subsequent interval, another pulse appears at the terminal 108 resulting in new information being stored and used to control activation of the lamps.

FIGS. 4, 5*a*, 5*b* and 6 illustrate a completely digital system for monitoring the rate of operation of a machine or process. First with reference to the block diagram of FIG. 4, the form of the invention includes a rate control setting circuit 201 which is manually set by a dial 202 to a rate of operation which is to be taken as a standard or optimum rate. The circuit 201 controls the operation of a precision variable oscillator 203 such that the frequency of the oscillator 203 is adjustable using the dial 202. Once the dial 202 has been set at a selected value, it is left at this value while the operation of the machine is being monitored.

The output of the oscillator 203 is fed to a rate divide circuit 204 and to a rate range selector switch 206 which permit a selection of two frequency ranges. The output of the oscillator circuit 203 is further connected by a line 205 to a sequence control and counter circuit 207 which also receives pulses generated in response to the operation of a machine or process to be monitored. A sensor 208 is connected to the machine or process such that it is actuated once for each cycle of operation. An interface circuit 209 is connected to receive the output of the sensor 208 and provides, in the present instance, a square wave pulse for each cycle of operation. A pulse former 211 is connected to the output of the interface circuit 209 and produces a fixed width pulse for each pulse out of the interface circuit 209. The output of the circuit 211 is connected to the sequence control and counter circuit 207.

As will be explained in more detail hereinafter, the monitoring system is started in operation by connecting power to the system and by actuating a reset or start switch 212. Thereafter, pulses from the pulse former 211 are fed to the counter in the circuit 207. At the same time, the signal from the variable oscillator 203 is fed through the circuit 204 and the switch 206 to a counter 213. When the counter in the circuit 207 reaches a certain value, in the present instance this value being ten cycles, it starts the operation of the sequence control portion of the circuit 207. This sequence control first generates a pulse which is fed over a line 214 and resets one part of the counter 213. The sequence control and counter circuit 207 then generates another pulse on a line 216 which transfers the output of a count decode circuit 217 to a storage and rate decode circuit 218. The circuit 217 forms a temporary storage for the count in the counter 217 and a signal on the line 216 effects a transfer of the information from the circuit 217 to a permanent storage in the circuit 218. The circuit 218 energizes one of three indicators 219, 220 and 221 depending upon the information received from the counter 213. Another pulse on the line 214 resets the remainder of the counter 213. Finally, the sequence control circuit 207 resets itself and initiates a new monitoring or sampling period.

As previously mentioned, the sequence control and counter circuit 207 counts ten cycles of operation of the machine or process, and at the end of the tenth cycle it transfers the count in the counter 213 to the circuit 218. Since the variable frequency oscillator circuit 203 is held at a fixed frequency during a sampling period of the ten cycles, it will be apparent that the count in the counter 213 will be determined by the length of time required for the machine or process to complete ten complete cycles. Therefore, the count in the counter 213 will be an indication of the rate of operation of the machine or process. At any given setting of the dial 202, the oscillator 203 generates cycles or pulses at a certain rate, and a certain length of time is required for the counter 213 to reach a count value which is taken as 100% of rated operation. If the machine or process being monitored goes through ten complete cycles during this length of time, at the point when the counter 213 is reset, the circuit 218 will respond to the fact that the rated count value has been achieved and will activate the indicator 221. If between 90% and 100% of the rated operation is achieved, the indicator 220 will be energized, whereas if less than 90% of the rated operation is achieved, the indicator 219 will be energized. Such operation has a very important advantage in that the count decode circuit 217 and the storage circuit 218 are required only to sense whether a certain count has been reached in the counter 213, and it is not necessary for these circuits to determine the exact count. It is only necessary to determine whether the count has reached or exceeded a certain value. Such operation makes the construction and operation of the system relatively simple and it may be relatively inexpensively constructed.

The system further preferably includes components for indicating when the length of time between adjacent cycles of operation of the machine or process is longer than a predetermined value. This apparatus includes a gating circuit 226 which receives the machine or process generated pulses over a line 227 which is connected to the output of the pulse former 211. This circuit further includes a counter 228 which receives pulses by way of a conductor 229, from the counter 213, the pulse frequency on the line 229 being a function of the oscillator 203 frequency. During each cycle of operation of the machine, the counter 228 counts pulses, and at the end of each machine cycle, the counter 228 is reset and starts a new count. If the count in the counter 228 reaches a certain value during any cycle of the machine, it actuates an alarm/generator 231 which has its output connected to the decode circuit 218. Preferably, the generator and the decode circuit 218 are connected to cause the indicator 219 to flash on and off to indicate an excessive length of time between adjacent machine cycles. A manually operated switch 232 may also be provided to permit manual operation of the indicator 219. A manually operable clear alarm switch 233 is provided to reset the gating circuit 226 and the generator 231 after the generator 231 has been actuated, and to shut down the counter 228 and deenergize the flashing indicator 219. The decode circuit 218 then continues to energize one of the three indicators 219, 220 or 221 to display the information which was previously displayed before the flash generator 231 was energized. If either the indicator 221 or 222 was energized before the flash generator 231 tripped, it will continue to be energized while the indicator 219 is flashing.

FIGS. 5*a* and 5*b* illustrate in greater detail the system shown in FIG. 4. The waveforms shown in FIG. 6 are identified by underlined letters of the alphabet, and the underlined letters appearing in FIGS. 5*a* and 5*b* indicate the circuit locations where the various waveforms appear. The oscillator 203 may be any type of accurate variable frequency oscillator, but in the present instance, a voltage controlled variable frequency oscillator is employed. The dial 202 may be connected to control the setting of a precision variable resistor which is connected to control the voltage in the input of the oscillator. The frequency of the oscillator 203 may be variable between, for example, 1 Khz and 10Khz, and produces a 50% duty cycle output signal P which varies between zero and five volts.

The output of the oscillator 203 is connected to the clock input of a flip-flop 240 of the rate divide circuit 204, and to a fixed contact 241 of the rate range switch 206. The oscillator 203 output is also connected by the line 205 to the sequence control and counter 207. The flip-flop 204 is interconnected with a second flip-flop 242 to form a divide-by-four circuit, the Q output of the second flip-flop 242 being connected to a second fixed contact 243 of the switch 206. When the switch 206 is in the position shown in FIG. 5*a* wherein the movable switch contact engages the fixed contact 241, the signal fed to the counter 213 will equal the oscillator 203 frequency, whereas when the movable contact engages the other fixed contact 243, the signal to the counter 213 will equal the oscillator frequency divided by four.

The counter 213 includes two components 246 and 247 which are connected to form either a divide-by-eighteen or a divide-by-thirty-six circuit. The movable contact of the switch 206 is connected to the clock inputs of both components 246 and 247, and the carry output of the component 246 is connected by a line 248 to an input of the component 247. The clear input of the two components 246 and 247 are connected by a line 249 to one input 251 of a NAND gate 252. The A and C terminals of the component 246 are connected to two inputs of a NAND gate 253, and the A terminal of the component 247 is connected to another input of the NAND gate 253. A fourth input of the gate 253 is connected by a switch 255 to the B terminal of either the component 246 or 247. The output of the NAND gate 253 is connected to one input of another NAND gate 254 which has a second input 256 connected to one of two conductors forming the line 214, leading from the sequence control and counter 207. The output of the NAND gate 253 is connected to one input of still another NAND gate 257 which has its output connected to the line 249, and a second input connected to a steady state positive voltage Vcc. The NAND gate 252 further includes a second input 258 connected by a line 259, the second of the conductors forming the line 214 to receive an enabling signal from the sequence control and counter 207. When the switch 255 is connected to the B terminal of the component 247, as is shown in FIG. 5*a*, for every thirty-six pulses passing through the switch 206 to the components 246 and 247, one pulse appears at the output of the gate 253. When the switch 255 is connected to the B terminal of the component 246, there is one output pulse for every eighteen pulses through the switch 206. Assuming that the input 256 of the gate 254 is high, each such output pulse of the gate 253 also appears at the input 251 of the gate 252, and it also clears the two components 246 and 247.

When the signal D on the input 258 is high, a train of pulses C appears at the output 261 of the NAND gate 252, the pulses on the output 261 having the same frequency as the pulses out of the divide-by-thirty-six circuit. Thus, for every thirty-six pulses appearing on the movable contact of the switch 206, one pulse will appear at the input 251 and at the output 261 of the gate 252. With reference to FIG. 5*b*, the output 261 is connected to the clock inputs of five components 262, 263, 264, 265 and 266 which are connected to form a binary coded decimal (BCD) counter which counts the number of pulses passed through the gate 252. As this counter counts up pulses, output signals appear on conductors 268 connected to the A and B outputs of the components 262 through 266, and these output signals place information in the count decode circuit 217 which comprises a temporary storage unit.

With reference again to FIG. 5*a*, the sensor 208 and the interface circuit 209 may be identical with the corresponding components included in the block 11 of FIG. 2. The output signal A of the interface circuit 209 appears on a conductor 271 which is connected to an input of a multivibrator circuit 272. The output signal B of the multivibrator circuit 272 appears on a conductor 273 and consists of a pulse 270 having a fixed time duration or width, for each cycle of operation of the machine or process. The time duration or width of the output pulses 270 is determined by the component values of a capacitor 274 and a resistor 276 which form part of the multivibrator circuit 272.

The sequence control and counter 207 receives the pulses 270 and includes a flip-flop 281 which has its clock input connected to receive the pulses 270. The clear input of the flip-flop 281 is connected to a manually operable start or reset switch 212 which is also shown in FIG. 4. When the switch 212 is closed, the clear input is connected to ground or common, and when the switch 212 is open, the clear input is connected to a positive voltage source Vcc. The switch 212 is momentarily closed once at the beginning or start-up of the system, and such closure provides a pulse 277 which clears the flip-flop 281. The falling edge of the next subsequent pulse 270 out of the pulse former 211 sets the flip-flop 281 resulting in a high signal D at its Q output 282. This output 282 is connected by one of the lines 214 to the input 258 of the NAND gate 252, and when the signal D is high, it opens the gate 252 to permit passage of oscillator pulses C from the line 251 to the output conductor 261 and to the counter.

The pulse former output 273 is also connected to one input 286 of a NAND gate 287, and the Q output 282 of the flip-flop 281 is connected to a second input 288 of the NAND gate 287. Consequently, when the output 282 is high, which occurs after the reset button 212 has been actuated and the next machine generated pulse has appeared, the machine generated pulses will pass through the gate 287 and pulses 278 of the waveform F appear on a line 291 which is connected through an inverter 280 to an input 292 of a counter 293. The counter 293 also has its clear input connected to the $\overline{Q}$ output of the component 281. The counter 293 produces one output pulse 279 (waveform G) on an output connection 294 for every ten input pulses or every five input pulses, depending on the position of a switch 295, received from the pulse former 211. The component 293 is a combination of a divide-by-two counter and a divide-by-five counter, and has an A output which is the output of the series connection of the two, or a divide-by-ten counter. The D output of the component 293 is taken from the divide-by-five counter alone. The switch 295 selects either the A or the D output. The pulse 279 on the conductor 294 is connected to the clock input of a flip-flop 296 which also has a set input connected to the switch 212 so that the flip-flop 296 will be set at the same time that the component 281 is cleared. The flip-flop 296 further has its clear input connected by a normally closed switch 297 to a reset line 298 to be referred to hereinafter. The switches 212 and 297 are preferably mechanically connected for simultaneous operation. The Q output (waveform H) of the flip-flop 296 is connected to the clear inputs of six flip-flops 301, 302, 303, 304, 305 and 306 which are interconnected to form a shift register, and the flip-flops are cleared by a reset pulse on the line 298 as will be explained on the falling edge of the pulse 279.

The clock input of each of the flip-flops 301 to 306 is connected to the line 205 which leads from the output P of the oscillator 203. The $\overline{Q}$ output I of the flip-flop 301 connected by one of the lines 214 to the input 256 of the NAND gate 254, the Q output K of the flip-flop 303 is connected by a line 307 to an input of the storage and rate decode circuit 218 as will be discussed later, the Q output M of the flip-flop 305 is connected to an input of a NAND gate 308, the Q output N of the flip-flop 306 is connected to an input of the flip-flop 301, and the Q output of the flip-flop 306 is connected to the line 298. The line 309 connected to the output of the NAND gate 308 is connected to another input of the count decode circuit 217.

Regarding the timing chart shown in FIG. 6, the waveforms preceding or above the point indicated by the reference numeral 280 are drawn to one time scale whereas the remaining waveforms below the point 280 are drawn to a different, greatly expanded, time scale. The waveform P represents the oscillator 203 signal whereas the waveform C represents this signal but at a much lower frequency because of the divide-by-thirty-six circuit components 246 and 247 and, depending on the position of the switch 206, the divide-by-four circuit 204. The upper set of waveforms G to N corresponds to the lower set of waveforms G to N, respectively, but of course on different time scales.

As previously mentioned, the outputs of the flip-flops 262 through 266 forming the oscillator signal counter are connected to inputs of the count decode circuit 217. The circuit 217 includes two NAND gates 315 and 316 which are connected to receive the output of this counter. The gates 315 and 316 may be connected to respond to the attainment of any desired count, but in the present instance, the gate 315 is connected to respond to a count of 10,001 cycles, whereas the second gate 316 is connected to respond to the attainment of a count of 11,112 oscillator cycles. Each of the components 262 through 266 has four output connections A,B,C & D which, when the component is cleared, have a low voltage thereon. A high signal on the terminal A represents a count of one; a high signal on the terminal B represents a count of two; a high signal on the terminal C represents a count of four; a high signal on the terminal D represents a count of eight. The gate 315 has two inputs, one connected to the A terminal of the flip-flop 262 and the other connected to the A terminal of the flip-flop 266. The output of the gate 315 is normally high but it becomes low when both of its inputs become high, and this occurs only when the count reaches 10,001 as previously explained. Similarly, the inputs of the gate 316 are connected to the A outputs of the four components 263 through 266 and also to the B output of the component 262. With these connections, the output of the gate 316 is normally high but will be actuated to a low condition when a count of 11,112 is reached as previously explained.

The outputs of the two gates 315 and 316 are respectively connected to the clock inputs of two components 317 and 318 which have their clear inputs connected to the conductor 309. The Q outputs of the two components 317 and 318 are connected to two flip-flops 321 and 322, respectively. Each of the flip-flops 321 and 322 also has a clock input connected to the line 307. The Q output of the flip-flop 321 is connected to inputs of two gates 323 and 324 and its $\overline{Q}$ output is connected to the input of a NAND gate 325. The $\overline{Q}$ output of the flip-flop 322 is connected to an input of the gate 324 and its Q output is connected to inputs of the two NAND gates 323 and 325. The outputs of the gates 323 through 325 are connected to additional gates 327, 328 and 329 similar to the first embodiment of the invention described, and the outputs of the latter gates are connected to control operation of three load handling circuits 331 which in turn control energization of the three indicators 219, 220 and 221. The portion of this circuit consisting of the indicators, the load handling device 331, the gates 327 through 329, and the gates 323 through 325 are the same in construction and operation as the corresponding components of the first described form of the invention.

In the specific embodiment of the invention illustrated and described in connection with FIGS. 4 to 6, with the switches 255 and 295 in the positions shown, ten complete cycles of operation of the machine or process are counted, and during the count of the ten cycles, pulses from the oscillator are also counted. As mentioned, the components 246 and 247 form a divide-by-thirty counter. If the switches 255 and 295 were manually placed in their other positions, a rate sampling would be taken every five machine cycles, and the components 246 and 247 would form a divide-by-eighteen counter. Of course other values could be chosen. If it is assumed that, when the machine is operating at its rated or optimum speed, the counter for the oscillator pulses will reach a count of 10,000 cycles during the time the machine is moving through ten complete cycles of operation, then a final oscillator count of 10,000 cycles or less will indicate that the machine or process is operating at greater than rated speed, whereas if the final count is 10,001 cycles or more, then the machine or process is operating at less than 100% of rated speed because a a greater length of time is required for the machine or process to complete ten full cycles. The system is therefore designed to detect the attainment of a count of 10,001. As previously mentioned, the system is also arranged to detect the attainment of a count of 11,112 oscillator pulses, thereby indicating that the machine is operating at 90% of rated speed or less. Since the system always counts ten cycles, in the arrangement shown in the drawings, of the machine or process and since a 10,000 count always indicates rated speed of operation, the construction of the system is greatly simplified. The operator of the system may make an adjustment for different speeds of operation to be taken as rated value simply by changing the frequency of oscillation of the oscillator. The system is also simplified due to the fact that it is not necessary to determine the exact count in the oscillator counter; it is only necessary to determine whether a selected count or counts has been reached. Regardless of the setting of the switches 255 and 295, the foregoing count of oscillator pulses will be as described above. The switches 255 and 295 are preferably mechanically connected for simultaneous operation.

To set the system in operation, the operator applies power to the system, and using the dial 202, adjusts the variable frequency oscillator 203 to a desired rate of machine operation to be taken as the rated value. The operator then actuates the reset switch 212 which generates the pulse 277. The next subsequent pulse generated by the machine actuated switch 208 results in triggering of the flip-flop 281 which opens the gate 252 and permits the oscillator cycles to pass to the oscillator counter consisting of the five components 262 through 266. The machine generated pulses are also passed to the counter 293, and, upon the eighth cycle of the machine, a pulse 279 (waveform G) appears at the output of the counter 293, and at the tenth cycle of the machine, the falling edge 279*a* of the pulse 279 actuates the flip-flop 296. This action produces a pulse (waveform H) at the Q output of the flip-flop 296 which releases the clear of the six flip-flops 301 through 306. Thereafter, the oscillator pulses on the line 205 are counted by the flip-flops 301 through 306. After the first oscillator pulse appearing on the line 205, the waveform I on the $\overline{Q}$ output of the flip-flop 301 becomes low, which results in a high output of the gate 254 and a low input 251 to the gate 252, thereby preventing further oscillator pulses from flowing to the counter 213. The second pulse on the line 205 from the oscillator generates the pulse of the waveform J, but it serves merely to provide a time delay. The next oscillator pulse produces a pulse in the waveform K which is connected by the line 307 to the inputs of the two components 321 and 322. This causes the information temporarily stored in the two components 317 and 318 to be transferred through the gates 323 to 325 and 327 to 329 to the load handling devices 331 and to energize one of the indicators 219 through 221. The next pulse on the line 205 provides a pulse on the waveform L, but again it serves merely to provide a time delay. The next oscillator pulse on the line 205 produces a signal in the waveform M which causes the output 309 of the gate 308 to become low and clear the components 262 through 266 and the components 317 and 318. The next pulse on the line 205 results in the positive pulse of the waveform N and a negative pulse on the $\overline{Q}$ output of the flip-flop 306 which results in resetting or clearing of the flip-flops 296 and 301 through 306. At the end of every tenth machine pulse, the sequencing operation is initiated, and at the end of the sequencing operation, the reset pulse clears the flip-flops 296 and 301 to 306, the entire sequencing operation occurring before receipt of the next machine pulse. The system then goes through another rate sampling. After the machine has operated through another ten complete cycles of operation, the count information is again transferred from the components 321 and 322 to the permanent storage, load handling device 331 and a different or the same indicator is energized.

During the sequencing operation, the waveform I pulse prevents pulses from being counted by the components 262 to 266, but since the entire sequencing operation occurs within a very short time, only six oscillator pulses (waveform P), this error in the count made by the components 262 to 266 is insignificant.

The foregoing described system indicates the rate of operation of the machine or process, averaged over ten complete cycles of operation, but it is often desirable to be able to determine whether the length of time required to complete a cycle exceeds a certain limit. For example, if a machine should become jammed, it would be desirable to indicate this fact quite quickly, and this may be done in accordance with the present invention by providing means to detect an excessive length of time. To this end, the machine generated pulses appearing on the line 227 are passed to NAND gates 341 and 342 and to the shutdown counter 228. The gate 341 has one input connected to the line 227 and a second input which is normally connected through a resistor 343 to a positive voltage source. However, when the clear alarm switch 233 is actuated, this input is connected to ground. If both of the inputs to the gate 341 are high, as occurs when the switch 233 is open and for a portion of each cycle of the machine or process, the output of the gate 341 becomes low and the output of the gate 342 becomes high. Conversely, when the line 227 is low, the output of the gate 342 is high. The output of the gate 342 is connected to a line 343 which is connected to the clear inputs of four BCD counters 344, 345, 346 and 347 in the shutdown counter 228. The clock inputs of the four flip-flops 344 through 347 are connected to the line 261 which receives the oscillator pulses at the output of the gate 252. The A output of the BCD counter 347 is connected to the clock input of a flip-flop 351. If, in a cycle of operation of the machine or process, the number of pulses from the oscillator on the line 261 reaches 1,000, the output A of the BCD counter 347 becomes high, and if the number reaches 2,000, the output A goes low. A count of 2,000 indicates that at least twice the normal length of time has elapsed for a complete machine cycle, because if a count of 10,000 is taken as indicating rated operation over ten machine cycles, then a count of 1,000 would be normal for one cycle. Thus, 2,000 counts in the counter 228 indicate that twice the normal length of time is required for a machine cycle.

Assuming that a count of 2,000 is reached, the flip-flop 351 is activated by the falling edge of the signal on the output A of the BCD counter 347, causing the Q output of the flip-flop 351 to fall and the $\overline{Q}$ output to rise. The rising edge of the $\overline{Q}$ output signal passes through a capacitor 352 and a resistor 353 resulting in a sharp positive going pulse which appears at the base of a transistor 354. The collector of the transistor 354 thus has a negative going current pulse appearing thereon which is connected to the set input of a flip-flop 356. The Q output of the flip-flop 356 is connected to an input of a NAND gate 357 interposed between the two gates 324 and 329, and the $\overline{Q}$ output of the flip-flop 356 is connected to an input of another NAND gate 358 which is interposed between the gate 329 and another gate 359. The gate 359 has one input connected to Vcc and another input connected to the output of the gate 324. The negative going pulse at the set input of the flip-flop 356 results in the Q output of this flip-flop becoming high and the indicator 219 to be energized.

Simultaneously with the foregoing, the Q output of the flip-flop 351 becomes low and turns off a transistor 361 which is normally biased on. When the transistor 361 is turned off, a capacitor 362 is charged through a resistor 363 until the breakdown voltage of a uni-junction transistor 364 is reached, at which time it conducts and discharges the capacitor 362. The capacitor 362, the resistor 363 and the transistor 364 form a relaxation oscillator which produces a square wave signal connected to the base of a transistor 366. The latter transistor 366 amplifies and inverts this square wave which is then connected to the clock input of the flip-flop 356. Consequently, the Q and $\overline{Q}$ outputs of the flip-flops 356 are alternately high and low, following the square wave output of the relaxation oscillator, and cause the indicator 219 to flash on and off. This flashing indicator, of course, indicates an excessive length of time between machine cycles as previously explained. If either the indicator 221 or 220 was previously energized, it will remain on.

To turn off the flashing signal and return the system to normal operation, the operator closes the switch 233 which closes the gate 341 and produces a low signal on a conductor 366 which is connected to the set input of the flip-flop 351 and to the clear input of the flip-flop 356. This action resets these components and stops the flashing of the indicator 219.

FIGS. 4 to 6 and the foregoing description set out a specific example of an operative system, but it should be understood of course that similar systems using different figures could be used. In FIGS. 5*a* and 5*b*, component part numbers are included in the drawings, but different logic systems could be used to achieve the desired results. In the form of the invention shown in FIGS. 4 to 6, a specific example was described wherein a rate sampling included ten machine pulses, but, as previously mentioned, a different number, such as five, could be used. In this event, the ten counter 293 could be separated into a five and a two counter, and the manually operable switch 295 could be adjusted to select the output of the five counter to actuate the flip-flop 296. If this were done, the switch 255 should also be changed to double the signal frequency to the components 262 to 266, this being accomplished by changing the components 246 and 247 from a divide-by-thirty-six counter to a divide-by-eighteen counter.

It will also be obvious that the connections to the indicators 219 and 220 could be arranged to effect a transition at 80% of rated speed, or any other percentage, rather than 90% as described. This transition may readily be changed by changing, using a switch as described below and shown in FIG. 7, the output connections of the counter components 262 to 266. A switch could also be provided between the shutdown counter 228 and the component 351 to select the length of time required for the component 351 to be actuated.

FIG. 7 illustrates a circuit that may be used in place of a portion of the circuit shown in FIG. 5*b*. As previously mentioned, a switching arrangement may be provided to enable an operator to select percentages of full rates other than 90%, and FIG. 7 illustrates a circuit for accomplishing this.

The FIG. 7 circuit includes a NAND gate 401 and five components 402 through 406 which correspond respectively to the gate 252 and the components 262 to 266 of FIGS. 5*a* and 5*b*. The connections to the gate 401 are the same as for the gate 252 and the input connections to the components 402 to 406 are the same as for the components 262 to 266. Another NAND gate 408 and connections thereto are also provided, which correspond to the gate 308 (FIG. 5*a*).

A percentage-of-rate select switch 411 is provided having a movable contact 412 and three positions 413, 414, and 415. The contact 412 is connected to ground, and the contacts 413 to 415 are respectively connected through invertors 417, 418 and 419 to inputs of three NAND gates 421, 422 and 423. The inputs of the NAND gates 421 to 423 are also connected through three resistors 426, 427 and 428 to a positive voltage Vcc.

As previously mentioned, a NAND gate can provide a negative going transition at its output only when all of its inputs are at high potentials. In the position of the switch 411 shown in FIG. 7, the output of the invertor 417 is high and the outputs of the invertors 418 and 419 are low, and therefore only the gate 421 output will respond to changes in voltage levels at its inputs. Similarly, if the switch contact 412 were at the position 414 or 415, only the gate 422 or 423 would respond to such voltage changes.

Each of the gates 421 to 423 has two additional inputs connected to selected outputs of the components 404 and 405, and the outputs selected determine the count attained by the components 402 to 406 at which all of the inputs of a particular gate 421 to 423 will all be positive or high. These counts correspond to different percentages of rated operation of the machine.

The A output of the component 406 is connected through an invertor 431 to an input of a flip-flop 432 which corresponds to the flip-flop 317 of FIG. 5*b*. With a count of 10,000 or less, the Q output of the flip-flop 432 will be low and an indicator corresponding to the indicator 221 will be energized, indicating 100% of rated operation. The Q output of the flip-flop 432 is also connected by a line 433 to an input of another NAND gate 434 which also has inputs respectively connected to the outputs of the gates 421 to 423. The outputs of the gates 421 to 423 are normally high and the selected gate shifts to low when its associated count is attained. The output of the gate 434 is connected through an invertor 436 to an input of a flip-flop 437 which corresponds to the flip-flop 318 of FIG. 5*b*.

At a count of 10,000 or less, the Q output of the flip-flop 432 is low and an indicator is energized to indicate 100% or more of rated operation. When a count of 10,001 is reached, this Q output shifts to high and deenergizes the indicator. This high output also appears at the gate 434, and since all of the gate 434 inputs are then high, a high input will appear at the flip-flop 437 and an indicator corresponding to the indicator 220 will be energized to indicate less than 100% of rated operation.

When the count which is determined by the connections of the gate 421 to the components 404 and 405 is reached, all of the inputs of the gate 421 will be high and its output will have a transistion to a low level. This occurs at a count of 10,000 plus an additional count which indicates, for example, less than 90% of rated operation. The output of the gate 434 will then become high and a third indicator corresponding to the indicator 219 will be energized to indicate less than 90% of rated operation. Of course, only one of the three indicators is energized at one time.

If the switch 411 were placed at one of the positions 414 or 415, the gate 434 output would shift to a high output at a different count which is determined by the connections of the gates 422 and 423 with the components 404 and 405. These counts for example can be at 80% and 70% of rated operation. Thus, an operator can set the switch 411 to have the system indicate whether the machine is operating at less than 90%, or 80%, or 70% of rated operation.

In the system illustrated and described in connection with FIGS. 4 to 6, a precision variable frequency oscillator 203 is provided and the oscillator dial 202 is adjusted by an operator to a figure which is taken as rated operation. As the frequency is increased, the figure is also increased because a shorter length of time will be required to reach the count which is taken as 100% of rated operation. By using the circuit illustrated in FIG. 8, the need for an expensive precision oscillator is avoided, but the operator may still adjust an oscillator frequency to a selected rated operation.

The FIG. 8 circuit includes a line 451 which is connected to receive the output of an oscillator similar to the oscillator 203 but which need not be a precision oscillator. The line 451 may be connected, for example, to the movable contact of the switch 206. The line 451 is connected to the inputs 452 of three components 453, 454 and 455. The three components 453 to 455 further have clear inputs 457 connected to a line 458, and strobe inputs 459 connected to a line 461. Three indicators 462, 463 and 464 are connected to the output lines 466 of the components 453 to 455, respectively, the indicator 462 showing units, the indicator 463 showing tens and the indicator 464 showing hundreds. The components 453 to 455, as will be explained hereinafter, form a decade counter for the signal on the line 451, a strobed latch and storage, and a decoder and driver for the indicators 462 to 464.

The circuit further includes a full wave rectifier 471 which is connected to receive 60 cycle AC line power, and which produces a full wave rectified signal. A voltage divider consisting of two resistors 472 and 473 is connected to the output of the rectifier 471, and a transistor 474 has its base connected to the juncture of the resistors 472 and 473. A 120 Hz signal appears on the collector of the transistor 474, which is connected to an input of a counter 476 which is connected with a NAND gate 477 to form a divide-by-twelve counter. One pulse appears at the output of the gate 477 for every six AC cycles at the input of the rectifier 471, and these pulses are connected to an input of a monostable multivibrator 478. The output of the multivibrator 478 is connected to the line 461 and also to the input of a second monostable multivibrator 479 which has its output connected to the line 458. For every pulse out of the gate 477, first a pulse appears on the line 461 and then a pulse appears on the line 458. The pulse on the line 461 causes the count in the counter portion of the units 453 to 455 to be stored in a strobe latch, and then the pulse on the line 458 clears the counters, decodes the stored count, and energizes the indicators 462 to 464. Consequently, on every sixth AC cycle, or every tenth of a second, a count is made and displayed of the oscillator frequency appearing on the line 451. With such a visual display, an operator can adjust the oscillator dial to a frequency which corresponds to a desired rated speed of operation.

What is claimed is:

1. A system for measuring the rate of occurrence of events in a cyclically occurring series of said events, comprising first means for sensing the occurrences of said events and for generating a train of pulses, each of said pulses representing one of said events, second means responsive to said train of pulses for providing a signal having a characteristic which represents the rate of occurrence of said events, preset comparator means for providing a preselected standard value of said characteristic and for comparing said characteristic of said signal with said standard value, and indicator means responsive to said comparator means for indicating said comparision.

2. A system for measuring the rate of occurrence of events in a cyclically occurring series of said events, comprising first means for sensing the occurrence of said events and for generating a train of pulses, each of said pulses representing one of said events, second means responsive to said train of pulses for providing a signal having a characteristic which represents the rate of occurrence of said events, comparator means for providing a standard value of said characteristic and for comparing said characteristic of said signal with said standard value, and indicator means responsive to said comparator means for indicating said comparison, said second means comprising a first circuit for generating a sampling time interval, and a second circuit providing said signal representing the number of said events occurring during said interval.

3. A system as in claim 2, wherein said second circuit comprises an integrator providing a voltage having a magnitude representing said number of cycles.

4. A system as in claim 2, wherein said first circuit is responsive to said first means and initiates a sampling time interval in synchronism with the occurrence of one of said events.

5. A system as in claim 2, wherein said second circuit includes means for adjusting the length of said time interval.

6. A system for measuring the rate of occurrence of events in a cyclically occurring series of said events, comprising first means for sensing the occurrences of said events and for generating a train of pulses, each of said pulses representing one of said events, second means responsive to said train of pulses for providing a signal having a characteristic which respresents the rate of occurrence of said events, comparator means for providing a standard value of said characteristic and for comparing said characteristic of said signal with said standard value, and indicator means responsive to said comparator means for indicating said comparison, said comparator means comprising means for adjusting said standard value.

7. A system for measuring the rate of operation of a cyclically operating machine, comprising first means for sensing each cycle of operation and generating a pulse in response thereto, second means for generating a sampling interval, third means responsive to said first and second means for generating a signal having a characteristic that is a function of the number of said pulses occurring during said sampling interval, preset comparator means for providing a preselected standard value and for comparing said characteristic with said standard value, and fourth means responsive to said comparator means for indicating said comparison.

8. A system as in claim 7, wherein said second means is coupled to said first means and includes means for initiating a sampling interval in synchronization with one of said pulses from said first means.

9. A system for measuring the rate of operation of events in a cyclically operating machine, comprising first means for sensing each cycle of operation and generating a pulse in response thereto, second means for generating a sampling interval, third means responsive to said first and second means for generating a signal having a characteristic that is a function of the number of said pulses occurring during said sampling interval, comparator means for providing a standard value and for comparing said characteristic with said standard value, and fourth means responsive to said comparator means for indicating said comparison, said third means comprising an integrator, and said characteristic comprising the magnitude of a voltage.

10. A system as in claim 9, wherein said integrator includes adjustable means for varying the amount of change in the magnitude of said voltage for each pulse from said first means.

11. A system as in claim 10, wherein said second means includes adjustable means for varying the length of said sampling interval, said adjustable means of said integrator and said adjustable means of said second means being coupled together for simultaneous adjustment.

12. A system as in claim 9, and further including reset means connected to the output of said second means for generating a reset pulse at the end of each sampling interval, said integrator means being connected to said reset means to be reset by each of said reset pulses.

13. A system for measuring the rate of operation of events in a cyclically operating machine, comprising first means for sensing each cycle of operation and generating a pulse in response thereto, second means for generating a sampling interval, third means responsive to said first and second means for generating a signal having a characteristic that is a function of the number of said pulses occurring during said sampling interval, comparator means for providing a standard value and for comparing said characteristic with said standard value, and fourth means responsive to said comparator means for indicating said comparison, said characteristic comprising the voltage magnitude of said signal, and said comparator means comprising at least one Schmitt trigger circuit connected to respond to said voltage magnitude.

14. A system as in claim 13, wherein two of said Schmitt trigger circuits are provided which are preset to be triggered at different voltage magnitudes, and said fourth means comprises an indicator and gating and storage circuits for storing signals received from said Schmitt trigger circuits and activating said indicator during a sampling interval.

15. A method of monitoring the rate of operation of a machine or process which operates in a cyclically repetitive manner, comprising the steps of sensing each cycle of said operation and generating a first signal in response thereto, generating a second signal representing a preselected unit of time, combining said first and said second signals to produce a third signal representing the number of said cycles occurring in said unit of time, comparing said third signal with a reference value representing a preselected standard rate of operation, and indicating the result of said comparison.

16. A system for measuring the rate of occurrence of events in a cyclically recurring series of said events, comprising first means connected to respond to said events and generating a first signal representing a number of the occurrences of said events, second means for generating a second signal representing a sampling time interval, third means providing a standard value of comparison representing a predetermined rate of occurrence of said events, one of said first and second signals being variable as a function of the rate of said events while the other of said first and second signals is held constant, and fourth means for providing an indication of a comparison of said variable signal with said standard value.

17. A system as in claim 16, wherein said first means comprises a variable voltage circuit for producing a voltage having a level representing said number of occurrences, said second means comprises a circuit for generating a signal at a fixed time interval, and said third means comprises a voltage level responsive trigger circuit.

18. A system as in claim 17, wherein said first means comprises an integrator circuit, said second means comprises a relaxation oscillator, and said third means comprises at least one Schmitt trigger circuit.

19. A system as in claim 16, wherein said first means comprises a first counter for providing said first signal after a fixed number of said occurrences, said second means comprising an oscillator and a second counter for said oscillator frequency, said second signal being the count output of said second counter, and said third means comprising gating circuits and connections of said second counter with said gating circuits.

20. A system as in claim 16, and further including shut-down means responsive to said first means and to timing means for providing an indication when the length of time for one of said occurrences exceeds a predetermined value.

21. A monitoring system for measuring the rate of occurrence of events in a cyclically recurring series of said events, comprising first means connected to respond to said events and generating a first signal after a predetermined number of occurrences of said events, an oscillator circuit and a counter connected to to the output thereof, gating and indicator means connected to said counter for providing an indication of the count therein, and second means responsive to said first signal for transferring said count to said gating and indicator means and for resetting said counter.

22. A system according to claim 21, wherein said second means comprises a sequencing circuit connected to receive the signal output of said oscillator circuit.

23. A system as in claim 21, wherein said first means is adjustable to change said predetermined number of occurrences.

24. A system as in claim 21, wherein said connection of said oscillator circuit with said counter is adjustable to change the frequency of the signal received by said counter.

25. A system as in claim 21, wherein gating and indicator means provides an indication of said count as a percentage of a standard rate, and further including means for adjusting the value of said percentage.

26. A system as in claim 21, and further including third means connected to the output of said oscillator circuit for indicating the frequency thereof, said third means further being connected to line power frequency and repetitively indicating said frequency as a function of line frequency.

27. A monitoring system for measuring the length of time required for the occurrence of an event, comprising an oscillator, counting means, counter actuating means connected to control flow of pulses from said oscillator to said counter to be counted, said actuating means further being connected to respond to said events to enable said pulse flow to said counter only during the time duration of said event, and indicating means connected to said counter for indicating when the count therein and reaches a predetermined limit.

28. A method of monitoring the rate of operation of a machine or process which operates in a cyclically repetitive manner, comprising the steps of sensing each cycle of said operation, counting the number of said cycles up to a preset number, generating a signal representing time, utilizing said signal to determine the elapsed time from a first cycle until said preset number is reached, providing a preset standard of time, comparing said elapsed time with said preset standard of time, and providing an indication of said comparison.

29. A method of monitoring the rate of operation of a machine or process which operates in a cyclically repetitive manner, comprising the steps of sensing each cycle of said operation counting the number of said cycles up to a preset number, generating a train of pulses at a fixed frequency, counting the number of said pulses until said preset number of cycles is reached, providing a preselected standard count of pulses, comparing said pulse count with said preselected standard count, and providing an indication of said comparison.

30. A method of monitoring the rate of operation of a machine or process which operates in a cyclically repetitive manner, comprising the steps of sensing each cycle of said operation and generating a first signal in response thereto, generating a second signal representing time, combining said first and said second signal to produce a third signal representing the length of time required to attain a preselected number of said cycles, comparing said third signal with a reference value representing a preselected standard rate of operation, and indicating the result of said comparison.

* * * * *